US007831379B2

(12) United States Patent
Nathan et al.

(10) Patent No.: US 7,831,379 B2
(45) Date of Patent: Nov. 9, 2010

(54) ROADSIDE SIGNAGE CONTROL FROM VEHICLE OPERATING DATA

(75) Inventors: John F. Nathan, Highland, MI (US); H. Winston Maue, Northville, MI (US)

(73) Assignee: Lear Corporation, Southfield, MI (US)

( * ) Notice: Subject to any disclaimer, the term of this patent is extended or adjusted under 35 U.S.C. 154(b) by 938 days.

(21) Appl. No.: 11/675,196

(22) Filed: Feb. 15, 2007

(65) Prior Publication Data

US 2007/0198169 A1 Aug. 23, 2007

Related U.S. Application Data

(60) Provisional application No. 60/774,555, filed on Feb. 17, 2006.

(51) Int. Cl.
*G08G 1/065* (2006.01)

(52) U.S. Cl. ..... 701/117; 340/928

(58) Field of Classification Search ..... 340/928
See application file for complete search history.

(56) References Cited

U.S. PATENT DOCUMENTS 5,381,155 A * 1/1995 Gerber ..... 342/104
5,729,214 A * 3/1998 Moore ..... 340/905
5,771,484 A * 6/1998 Tognazzini ..... 701/117
5,778,332 A * 7/1998 Chang et al. ..... 701/117
5,822,712 A * 10/1998 Olsson ..... 701/117
5,892,461 A * 4/1999 Dokko ..... 340/907
5,926,113 A * 7/1999 Jones et al. ..... 340/906
5,986,575 A * 11/1999 Jones et al. ..... 340/906
6,232,889 B1 * 5/2001 Apitz et al. ..... 340/906
6,255,956 B1 7/2001 Tingley et al.
6,278,358 B1 8/2001 Spoto et al.
6,278,377 B1 8/2001 DeLine et al.
6,317,108 B1 * 11/2001 Kalt ..... 345/85
6,341,255 B1 * 1/2002 Lapidot ..... 701/209
6,418,371 B1 * 7/2002 Arnold ..... 701/117
6,427,113 B1 * 7/2002 Rahman ..... 701/117
6,427,114 B1 * 7/2002 Olsson ..... 701/117
6,437,687 B2 8/2002 Spencer
6,490,519 B1 * 12/2002 Lapidot et al. ..... 701/117
6,575,902 B1 6/2003 Burton
6,633,808 B1 * 10/2003 Schulz et al. ..... 701/117
6,731,940 B1 * 5/2004 Nagendran ..... 455/456.1
6,870,487 B2 * 3/2005 Nuesser et al. ..... 340/901
7,110,880 B2 * 9/2006 Breed et al. ..... 701/207
7,167,104 B2 * 1/2007 DiPiazza ..... 340/905
7,319,379 B1 * 1/2008 Melvin ..... 340/438
7,447,569 B2 * 11/2008 Weis et al. ..... 701/1
7,482,948 B1 * 1/2009 Northway et al. ..... 340/925
7,511,634 B2 * 3/2009 Stehle et al. ..... 340/905
2002/0065599 A1 * 5/2002 Hameleers et al. ..... 701/117
2003/0063015 A1 * 4/2003 Ebner et al. ..... 340/907
2004/0044293 A1 3/2004 Burton
2004/0104590 A1 6/2004 Kikuchi et al.
2004/0220721 A1 * 11/2004 Chiang ..... 701/117

(Continued)

*Primary Examiner*—Khoi Tran
*Assistant Examiner*—Brian J Broadhead
(74) *Attorney, Agent, or Firm*—Brooks Kushman P.C.

(57) ABSTRACT

Method and system to alert drivers to driving related information thought controlling information displayed on one or more roadside displays. The displayed information may related to traffic flow, road conditions, emergencies, and any other type of information. Optionally, the displayed information may be determined at least in part of data collected from onboard the vehicles.

20 Claims, 1 Drawing Sheet

U.S. PATENT DOCUMENTS

2004/0249560 A1* 12/2004 Kim et al. ..... 701/117
2005/0012606 A1 1/2005 Lee
2005/0040970 A1* 2/2005 Hutchins et al. ..... 340/907
2005/0041819 A1 2/2005 Brown
2005/0131627 A1* 6/2005 Ignatin ..... 701/117
2005/0231385 A1* 10/2005 Haase ..... 340/905
2005/0267658 A1* 12/2005 Yuan et al. ..... 701/36
2006/0136090 A1* 6/2006 Koromyslov et al. ..... 700/200
2006/0142933 A1* 6/2006 Feng ..... 701/117
2006/0197682 A1* 9/2006 Crocker et al. ..... 340/902
2007/0088494 A1* 4/2007 Rothman et al. ..... 701/200
2007/0118273 A1* 5/2007 Tang et al. ..... 701/117
2007/0135990 A1* 6/2007 Seymour et al. ..... 701/117
2007/0198169 A1* 8/2007 Nathan et al. ..... 701/117
2007/0244627 A1* 10/2007 Boss et al. ..... 701/117
2008/0221783 A1* 9/2008 Boss et al. ..... 701/117
2010/0094530 A1* 4/2010 Phuyal et al. ..... 701/117

* cited by examiner

ROADSIDE SIGNAGE CONTROL FROM VEHICLE OPERATING DATA

CROSS-REFERENCE TO RELATED APPLICATIONS

This application claims the benefit of U.S. provisional application Ser. No. 60/774,555, filed Feb. 17, 2006, the disclosure of which is hereby incorporated in its entirety.

BACKGROUND OF THE INVENTION

1. Field of the Invention

The present invention relates to controlling roadside signage and information displayed thereon.

2. Background Art

While traveling over roadways to any number of destination, vehicles may pass any number of roadway signs and indicators, commonly referred to as signage. The messages and information conveyed by the signage is typically fixed such that the same message is always shown. This can be problematic is road conditions are variable or otherwise different that which is described in the fixed message.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION OF THE PREFERRED EMBODIMENT(S)

Figure 1:
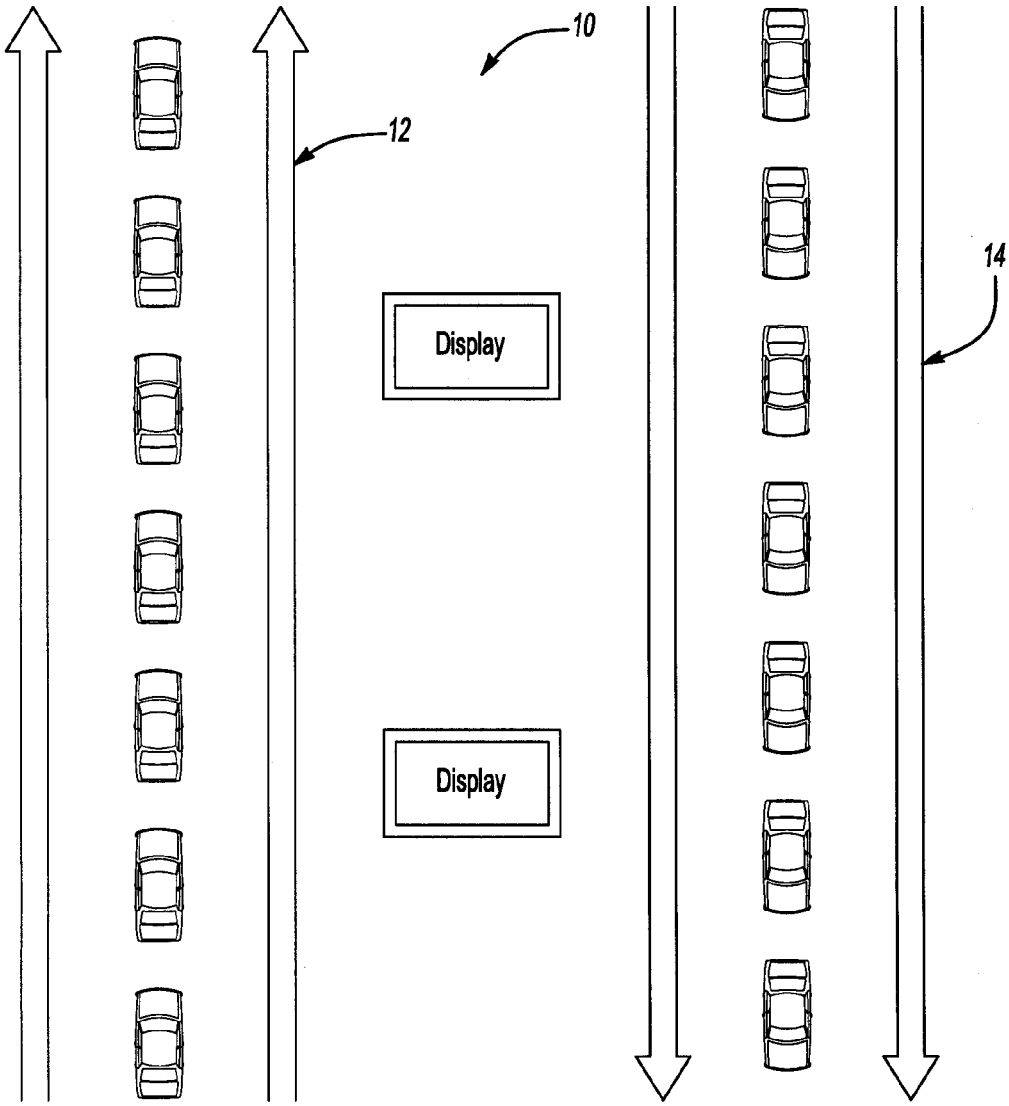
FIG. 1 illustrates a signage system in accordance with one non-limiting aspect of the present invention.

FIG. 1 illustrates a signage system 10 in accordance with one non-limiting aspect of the present invention. The system 10 may include a number of roadside displays positioned relative to a roadway having multiple lanes 12-14. The displays may be electronically controllable to display information to any number of vehicles traveling in either direction past the displays. The present invention contemplates controlling the displays to communicate any type of information to the passing vehicles.

Vehicles traveling on the left side 12 may be traveling in an opposite direction relative to the vehicles on the right side 14. The displays, or signs, may be bi-directional displays having capabilities to display different information to both directions of the travel. One side of the displays may be used to display information to vehicles approaching that side and the other side of the display may be used to display information to vehicles approaching that side of the displays, thereby allowing the same display to display information to both lanes. Of course, the displays may be one-side and need not be located between the multiple lanes of travel.

The displays may be configured to automatically display the information and/or one of the other displays or a central control entity may instruct the displays with the information to display. The information may be displayed through any form of communication, such as but not limited to graphical displays, textual displays, moving image, sounds, etc. This and other relevant information may be provided to the displays through wireline and/or wireless communications.

The displays may be controlled to display road related information as a function of data collected from systems onboard the vehicles. The vehicles my include a safety system, anti-lock braking system, global positioning system (GPS), stability control system, and/or any number other system(s) associated with operating or facilitating driving or non-driving related operations of the vehicle. The data used in the normal course of these systems may be monitored or otherwise accessed for use in controller the displays.

The data may be collected during normal operation of the vehicle system, such as collecting braking data during an anti-lock braking event, airbag deployment data from the safety system during an accident, vehicle travel speed from GPS system data, etc. The use of this data may be helpful in assessing current driving conditions based upon information obtained directly from vehicles traveling over the roadway and the operation of the same with respect to actual road conditions.

The information from the system onboard the vehicle can be processed to determine road moisture levels, road condition irregularities, traffic flow, and any number of other types of traffic or road condition related characteristics. The antilock braking system and/or traction control system data may be used to assess road moisture levels, such as but not limited to snow, ice, rain, etc. The stability system data may be used to determine road surface irregularities, such as but not limited to an obstacle in the road, mudslide, dangerous pot holes, etc. The GPS system data may be use to assess traffic flow, such as but not limited accident, traffic jam, etc.

The data collected from onboard the vehicle may be analyzed with other data collected from onboard the vehicle and/or from systems external to the vehicle. Traffic flow information may rely on a combination of vehicle and non-vehicle based information, such as for use in comparing current vehicle speeds against posted speed limits when assessing traffic congestion issues. Surface irregularities may be determined by comparing vehicle determined travel routes to known roadway directions, such as for use in assessing whether vehicles are driving over shoulders or off-road due an obstacle in the normal path of travel.

The data collected onboard the vehicle may be communicated from the vehicles through wireless communications. The data may be communicated from the vehicles to the displays directly as the vehicle travel past the displays and/or indirectly by way of the other vehicles or other wireless means. The other vehicles may be used to facilitate vehicle-to-vehicle communications where data is transferred from one vehicle to another before reaching the processing entity associated with controlling the displays. Similar communication paths may occur between the displays or other wireless devices near the roadway, such as cellular communication towers.

The data may travel from vehicle-to-vehicle and/or sign-to-sign until reaching a desired display or other location. Various displays or vehicles may capture information as it daisy-chains or otherwise travels to another destination, allowing each location to process the data as needed. The data may flow backwardly from a vehicle after it has passed a display, such as to facilitate displaying upcoming road condition information for vehicles traveling the same direction, and/or forwardly to indicate upcoming road condition information from vehicles traveling in the other direction.

The data used to determine the information shown on the displays may be processed by the vehicles, displays, and/or by some other central entity, such as a government regulated traffic entity. The processed data can be used as needed by the processing site, such that one site may display the information to show upcoming road condition information while and other another site may track the information for calculating traffic flow characteristics.

Figure 2:
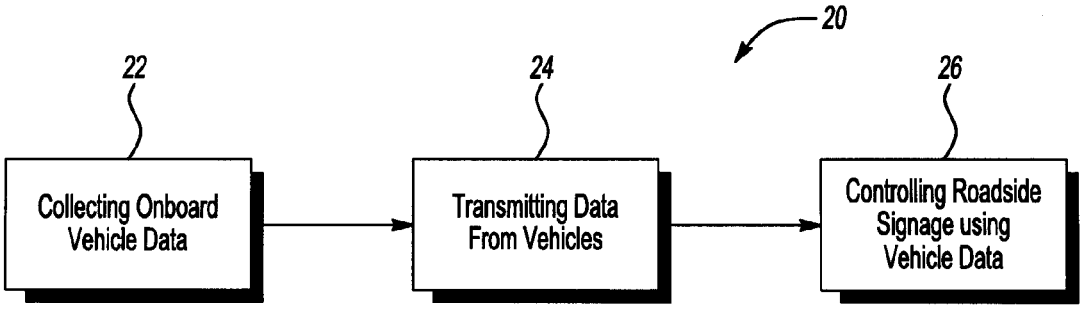
FIG. 2 illustrates a flow chart of a method of displaying roadside information in accordance with one non-limiting aspect of the present invention.

FIG. 2 illustrates a flow chart 20 of a method of displaying roadside information in accordance with one non-limiting aspect of the present invention. The method generally relates to displaying information relevant to vehicles traveling past a roadside sign, including displaying information to vehicle passing in different directions relative to the sign.

Block 22 relates to collecting data from systems onboard the vehicles. The data may be collected from vehicles system associated with driving related vehicle operations which are relevant to or influenced by driving related characteristics, such as but not limited to road conditions, traffic flow, etc. The data may be collected during the normal course of operation of the corresponding vehicle system. It may be stored on the vehicle for subsequent use.

Block 24 relates to transmitting the data from the vehicles to the sign and/or other processing element. The data may be transmitted wirelessly or otherwise from the vehicles, such as though vehicle-to-vehicle communications, vehicle-to-sign communications, or some combination thereof. The data may include identifiers, time stamps, location stamps, and other information suitable to determining the vehicle from which the data was collected and the location from which it was collected. The data may be transferred over a mesh network created by the vehicles and/or displays.

Block 26 relates to controlling information displayed on the sign at least based in part on the data collected from the vehicles. Because a portion of the data is collected from the vehicles, the data will reflect actual driving conditions of different vehicles traveling over the same roadway. This can be helpful in insuring accuracy and authenticity of the displayed information. The data may be continuously updated to reflect current conditions to keep drivers informed of changes in driving conditions.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of controlling roadside signage to reflect road conditions for vehicles traveling on roadways, the method comprising:

monitoring vehicle system data used in the operation of at least one vehicle system onboard one or more of the vehicles to facilitate driving related operations;

determining road conditions from the vehicle system data; and continuously controlling the signage to reflect road conditions, including adapting the signage to reflect changes in the road conditions as a function of changes in the vehicle system data.

2. The method of claim 1 further comprising the signage determining the road conditions from vehicle system data collected after the vehicles have driven past the signage.

3. The method of claim 1 further comprising utilizing vehicle-to-vehicle communications to communicate the vehicle system data to the signage for use by the signage in determining the road conditions.

4. The method of claim 1 further comprising determining the road condition related information from traction control system data.

5. The method of claim 4 further comprising controlling the signage to reflect road surface moisture levels as a function of the traction control system data.

6. The method of claim 1 further comprising determining the road condition related information from stability control system data.

7. The method of claim 6 further comprising controlling the signage to reflect road surface irregularities as a function of the stability control system data.

8. The method of claim 1 further comprising determining the road condition related information from anti-lock braking system data.

9. The method of claim 8 further comprising controlling the signage to reflect road surface moisture levels as a function of the traction control system data.

10. A method of controlling a roadside display having capabilities to controllably communicate information to vehicles traveling over a roadway, the method comprising:

controlling road related information shown on the display as a function of data received from one or more vehicles, the data corresponding with information collected from one or more vehicle systems onboard the vehicles.

11. The method of claim 10 further comprising displaying upcoming road related information for an upcoming portion of the roadway as a function of data received from vehicles after the vehicles travel past the display, the data collected from vehicles at the corresponding upcoming location.

12. The method of claim 11 wherein the data is carried backwardly to the display through vehicle-to-vehicle communications.

13. The method of claim 11 wherein the data is carried backwardly to the display through sign-to-sign communications.

14. The method of claim 10 further comprising utilizing the data to display traffic flow road related information.

15. The method of claim 10 further comprising utilizing the data to display road condition road related information.

16. A system for displaying information on a roadside sign, the system comprising:

one or more elements onboard multiple vehicles traveling over a roadway, the elements including data representative of vehicle operating conditions; and a processing element configured to control information displayed on the sign to reflect roadway conditions associated with vehicle operating conditions, wherein the processing element determines the information shown on the sign at least based in part on the data from the elements onboard the vehicles.

17. The system of claim 16 wherein the processing element is located on the sign.

18. The system of claim 17 wherein the vehicles wireless transmit the data to the processing element after passing the sign to facilitate displaying information associated with vehicle operating conditions at an upcoming location relative to vehicles traveling in a common direction.

19. The system of claim 17 wherein the vehicles wireless transmit the data to the processing element prior to reaching the sign to facilitate displaying information associated with vehicle operating conditions at an upcoming location relative to vehicles traveling in an opposite direction.

20. The system of claim 16 wherein the vehicles are configured to transmit the data through vehicle-to-vehicle communications.

* * * * *